US009079407B2

(12) United States Patent
Iwasa

(10) Patent No.: US 9,079,407 B2
(45) Date of Patent: Jul. 14, 2015

(54) INKJET APPARATUS AND METHOD OF COLLECTING MIST

(71) Applicant: SCREEN HOLDINGS CO., LTD., Kyoto-Shi (JP)

(72) Inventor: Hiroshi Iwasa, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/560,965

(22) Filed: Dec. 4, 2014

(65) Prior Publication Data

US 2015/0165771 A1 Jun. 18, 2015

(30) Foreign Application Priority Data

Dec. 13, 2013 (JP) ..... 2013-257852

(51) Int. Cl.
*B41J 2/15* (2006.01)
*B41J 2/165* (2006.01)

(52) U.S. Cl.
CPC ..... *B41J 2/16532* (2013.01)

(58) Field of Classification Search
CPC ..... B41J 2/16532; B41J 2/16555; B41J 2002/16555; B41J 2202/02
See application file for complete search history.

(56) References Cited

U.S. PATENT DOCUMENTS 7,845,758 B2 * 12/2010 Hayashi et al. ..... 347/29
7,959,255 B2 * 6/2011 Kubo ..... 347/30
8,690,290 B2 * 4/2014 Masuda ..... 347/30

FOREIGN PATENT DOCUMENTS

JP 2010-201873 A 9/2010
JP 2013-119218 A 6/2013

* cited by examiner

*Primary Examiner* — Lamson Nguyen
(74) *Attorney, Agent, or Firm* — McDermott Will Emery LLP

(57) ABSTRACT

An inkjet apparatus includes a switching part for switching the direction of movement of a base material, and a mist suction part for suctioning air containing ink mist. The switching part bends the base material in a direction opposite to a recording surface of the base material in a position downstream in the direction of movement as viewed from jet heads to switch the direction of movement from a first direction to a second direction. Thus, a viscous flow near the surface of the base material and the ink mist contained in the viscous flow are separated from the surface of the base material by the use of inertial force. The mist suction part includes a suction opening at least part of which is positioned on the extension of the first direction. This allows the mist suction part to efficiently suction the ink mist separated from the surface of the base material.

16 Claims, 7 Drawing Sheets

INKJET APPARATUS AND METHOD OF COLLECTING MIST

BACKGROUND OF THE INVENTION

1. Field of the Invention

The present invention relates to a technique for collecting ink mist in an inkjet apparatus which jets out ink droplets toward a recording surface of a strip-shaped base material while transporting the base material.

2. Description of the Background Art

An inkjet apparatus which records an image on a surface of a strip-shaped base material by jetting out ink from a plurality of heads while transporting the base material has heretofore been known. When the inkjet apparatus of this type jets out ink from the heads, fine ink mist is produced. If diffused in an enclosure of the inkjet apparatus, the ink mist adheres to electronic components, mechanical components and the like in the enclosure to result in the danger of a contact failure of connectors and the reduction in lifetime of components. To solve such a problem, a variety of techniques have heretofore been proposed to collect ink mist by suction.

For example, an inkjet printer including a mist suction unit disposed downstream in the transport direction of a paper transport unit is disclosed in Japanese Patent Application Laid-Open No. 2010-201873 (paragraph 0019 and FIG. 4). As another example, an inkjet apparatus including an exhaust part provided near a medium which has not yet been struck by ink from heads and for suctioning gases is disclosed in Japanese Patent Application Laid-Open No. 2013-119218 (paragraph 0038 and FIG. 1).

Unfortunately, when a strip-shaped base material is transported, an airflow referred to as a viscous flow is produced near the surface of the base material. The ink mist contained in this viscous flow is not separated from the surface of the base material by suction only. It has hence been difficult for the structures disclosed in Japanese Patent Application Laid-Open No. 2010-201873 and Japanese Patent Application Laid-Open No. 2013-119218 to sufficiently collect the ink mist contained in the viscous flow. For the collection of the ink mist contained in such a viscous flow, there has been a need to forcefully separate the viscous flow from the surface of the base material by means of an air knife.

In particular, the force required to separate the viscous flow from the surface of the base material increases with the increase in the speed of transport of printing paper. Therefore, the technique for collecting the ink mist contained in the viscous flow becomes more important as the processing capability of the inkjet apparatus increases.

SUMMARY OF THE INVENTION

It is therefore an object of the present invention to provide an inkjet apparatus and a mist collection method which are capable of collecting ink mist contained in a viscous flow moving near a surface of a base material without the use of an air knife.

A first aspect of the present invention is intended for an inkjet apparatus comprising: a transport mechanism for transporting a strip-shaped base material in a direction of movement along the length thereof; at least one jet head for jetting out ink droplets toward a recording surface of the base material; a switching part for bending the base material in a direction opposite to the recording surface in a position downstream in the direction of movement as viewed from the at least one jet head to switch the direction of movement from a first direction to a second direction; and a mist suction part for suctioning air containing mist of the ink from near the recording surface of the base material passing over the switching part, the mist suction part including a suction opening at least part of which is positioned on the extension of the first direction.

According to the first aspect of the present invention, the switching part switches the direction of movement of the base material to the direction opposite to the recording surface. Thus, a viscous flow and the ink mist contained in the viscous flow are separated from the recording surface of the base material by the use of inertial force. This allows the mist suction part to efficiently suction the separated ink mist.

A second aspect of the present invention is intended for a method of collecting mist resulting from the jetting of ink in an inkjet apparatus which jets out ink droplets from at least one jet head toward a recording surface of a strip-shaped base material while transporting the base material. The method comprises the steps of: a) bending the base material in a direction opposite to the recording surface in a position downstream in a direction of movement of the base material as viewed from the at least one jet head to switch the direction of movement; and b) suctioning air containing the mist separated from the recording surface of the base material in the step a).

According to the second aspect of the present invention, the direction of movement of the base material is switched to the direction opposite to the recording surface in the step a). Thus, a viscous flow and the ink mist contained in the viscous flow are separated from the recording surface of the base material by the use of inertial force. This allows the efficient suction of the separated ink mist in the step b).

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment according to the present invention will now be described with reference to the drawings.

<1. Configuration of Inkjet Apparatus>

Figure 1:
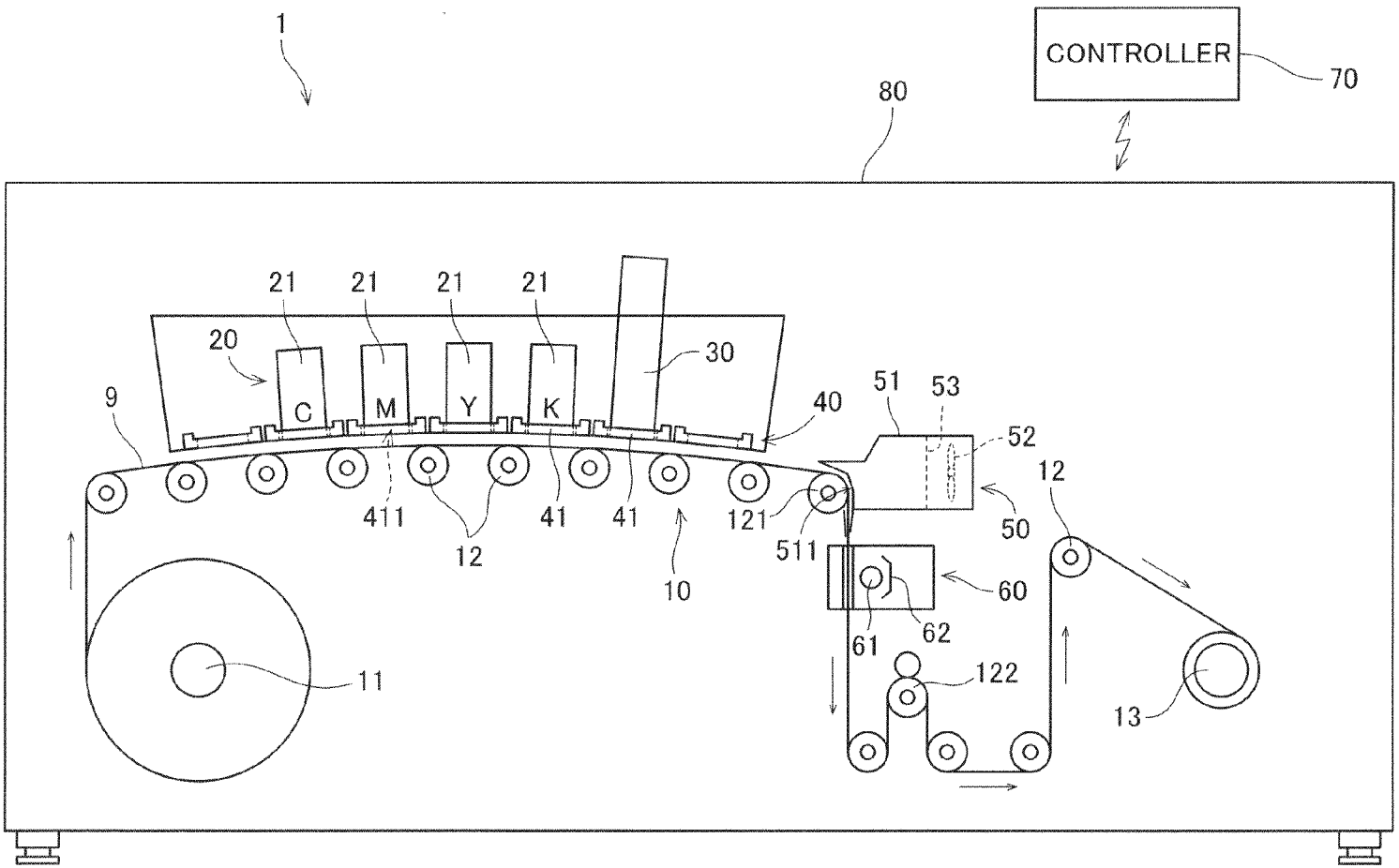
FIG. 1 is a view showing the configuration of an inkjet apparatus.

FIG. 1 is a view showing the configuration of an inkjet apparatus 1 according to one preferred embodiment of the present invention. This inkjet apparatus 1 is a printing apparatus which records a color image on a recording surface of printing paper 9 that is a strip-shaped base material by jetting out ink droplets from a plurality of jet heads 21 while transporting the printing paper 9. As shown in FIG. 1, the inkjet apparatus 1 according to the present preferred embodiment includes a transport mechanism 10, an image recorder 20, a viscosity increasing light irradiator 30, a support unit 40, a mist suction part 50, a fixing light irradiator 60, and a controller 70. The components except the controller 70 are housed in a box-like processing chamber 80.

The transport mechanism 10 is a mechanism for transporting the printing paper 9 in a direction of movement along the length thereof. The transport mechanism 10 according to the present preferred embodiment includes an unwinder 11, a plurality of transport rollers 12, and a winder 13. The transport rollers 12 include a switching roller 121 and nip rollers 122 to be described later. The printing paper 9 is unwound from the unwinder 11, and is transported along a transport path formed by the transport rollers 12. Each of the transport rollers 12 rotates about a horizontal axis to guide the printing paper 9 downstream in the direction of movement. The transported printing paper 9 is wound and collected on the winder 13.

As shown in FIG. 1, the printing paper 9 is moved substantially horizontally under the image recorder 20 in a direction in which the jet heads 21 are arranged. During the substantially horizontal movement, the recording surface of the printing paper 9 faces toward the jet heads 21 disposed thereover. The transport mechanism 10 further includes the switching roller 121 and the nip rollers 122 downstream from the image recorder 20 in the direction of movement.

The nip rollers 122 respectively rotate actively at a constant speed while grasping the printing paper 9 by contacting the recording surface and the back surface of the printing paper 9. The transport mechanism 10, on the other hand, adjusts the rotation speed of the unwinder 11 with respect to the rotation speed of the nip rollers 122. This applies tension to the printing paper 9. As a result, slack and wrinkles in the printing paper 9 are prevented during the transport.

The image recorder 20 is a mechanism for jetting out ultraviolet ray curable ink onto the printing paper 9 transported by the transport mechanism 10. The image recorder 20 according to the present preferred embodiment includes the four jet heads 21. The four jet heads 21 are arranged in the direction of movement of the printing paper 9. Each of the jet heads 21 has a lower surface provided with a plurality of nozzles. The nozzles are jet orifices for jetting out ink droplets. The nozzles are regularly arranged substantially across the width of the printing paper 9 which is orthogonal to the direction of movement of the printing paper 9. At the time of printing, ink droplets of four colors, i.e. Y (Yellow), M (Magenta), C (Cyan) and K (Black), which are color components of a color image are jetted out from the four respective jet heads 21 toward the recording surface of the printing paper 9. Thus, a color image is recorded on the recording surface of the printing paper 9.

The viscosity increasing light irradiator 30 is a mechanism for irradiating the printing paper 9 with a first type of irradiation light in a position downstream from the image recorder 20 in the direction of movement. A plurality of LED (Light Emitting Diode) light sources are regularly arranged on the lower surface of the viscosity increasing light irradiator 30. The first type of irradiation light emitted from the LED light sources includes ultraviolet rays of a wavelength band effective in curing the ink jetted out from the jet heads 21. Thus, the irradiation of the ink on the printing paper 9 with the first type of irradiation light increases the viscosity of the ink.

It should be noted that the first type of irradiation light emitted from the viscosity increasing light irradiator 30 is smaller in amounts than a second type of irradiation light emitted from the fixing light irradiator 60. Thus, the ink on the printing paper 9 is not completely cured. In other words, the ink of each color on the printing paper 9 is in a semi-cured state with a low fluidity. When the ink is semi-cured, the spread of the ink on the printing paper 9 is suppressed. This prevents the decrease in printing quality resulting from the spread of ink in the transport path downstream from the viscosity increasing light irradiator 30.

The support unit 40 includes a plurality of support bases 41 arranged in the direction of movement of the printing paper 9. Each of the four jet heads 21 and the viscosity increasing light irradiator 30 is attached to one of the support bases 41. Thus, the four jet heads 21 and the viscosity increasing light irradiator 30 are supported, and are placed in a mutually fixed positional relationship. Each of the support bases 41 has a through hole 411 in the center thereof for fitting the lower end portion of one of the jet heads 21 and the viscosity increasing light irradiator 30 therein. Thus, the lower surfaces of the respective jet heads 21 and the lower surface of the viscosity increasing light irradiator 30 which are attached to the support bases 41 are opposed to the recording surface of the printing paper 9 without being obstructed by the support bases 41.

In the example shown in FIG. 1, spare support bases 41 are disposed upstream from the four jet heads 21 in the direction of movement and downstream from the viscosity increasing light irradiator 30 in the direction of movement.

The switching roller 121 serving as a switching part is disposed downstream in the direction of movement as viewed from the image recorder 20 and the viscosity increasing light irradiator 30. The switching roller 121 rotates about a horizontal axis while contacting the back surface of the printing paper 9. This causes the printing paper 9 to be bent in a direction opposite to the recording surface. As a result, the direction of movement of the printing paper 9 is switched from a first direction to a second direction. In the present preferred embodiment, the first direction before the switching is a substantially horizontal direction, and the second direction after the switching is a vertically downward direction.

The switching roller 121 according to the present preferred embodiment contacts the back surface of the printing paper 9. For this reason, the surface of the switching roller 121 does not contact the ink in the semi-cured state. This prevents the decrease in printing quality on the printing paper 9 resulting from the contact with the switching roller 121. Also, there are no members for switching the direction of movement of the printing paper 9 on the recording surface side of the printing paper 9. This allows space for placement of the mist suction part 50 to be provided on the recording surface side of the printing paper 9.

The mist suction part 50 is a mechanism for suctioning air containing ink mist from near the recording surface of the printing paper 9 passing over the switching roller 121. The mist suction part 50 includes a tubular duct 51, a suction fan 52, and a filter 53. The duct 51 has a suction opening 511 which opens toward the recording surface of the printing paper 9. When the suction fan 52 is brought into operation, a negative pressure is developed in the duct 51 to produce an airflow directed from near the recording surface of the printing paper 9 through the suction opening 511 into the duct 51. This causes the suction of air containing the ink mist from near the recording surface of the printing paper 9. The suctioned ink mist is caught by the filter 53, and is hence collected.

The fixing light irradiator 60 is a mechanism for irradiating the printing paper 9 with the second type of irradiation light in a position downstream from the switching roller 121 in the direction of movement, i.e. vertically below the switching roller 121. The fixing light irradiator 60 according to the present preferred embodiment includes a metal halide lamp 61, and a reflector 62. The metal halide lamp 61 is a tubular light source extending in a horizontal direction.

The second type of irradiation light emitted from the metal halide lamp 61 includes ultraviolet rays of a wavelength band effective in curing the ink jetted out from the jet heads 21. Also, the second type of irradiation light emitted from the metal halide lamp 61 is sufficient in amounts for completely curing the ink. Thus, the irradiation of the ink on the printing paper 9 with the second type of irradiation light causes the ink to be cured, so that the ink is fixed on the printing paper 9.

After passing through the fixing light irradiator 60, the printing paper 9 then passes over the plurality of transport rollers 12 including the nip rollers 122, and is wound and collected on the winder 13.

Figure 2:
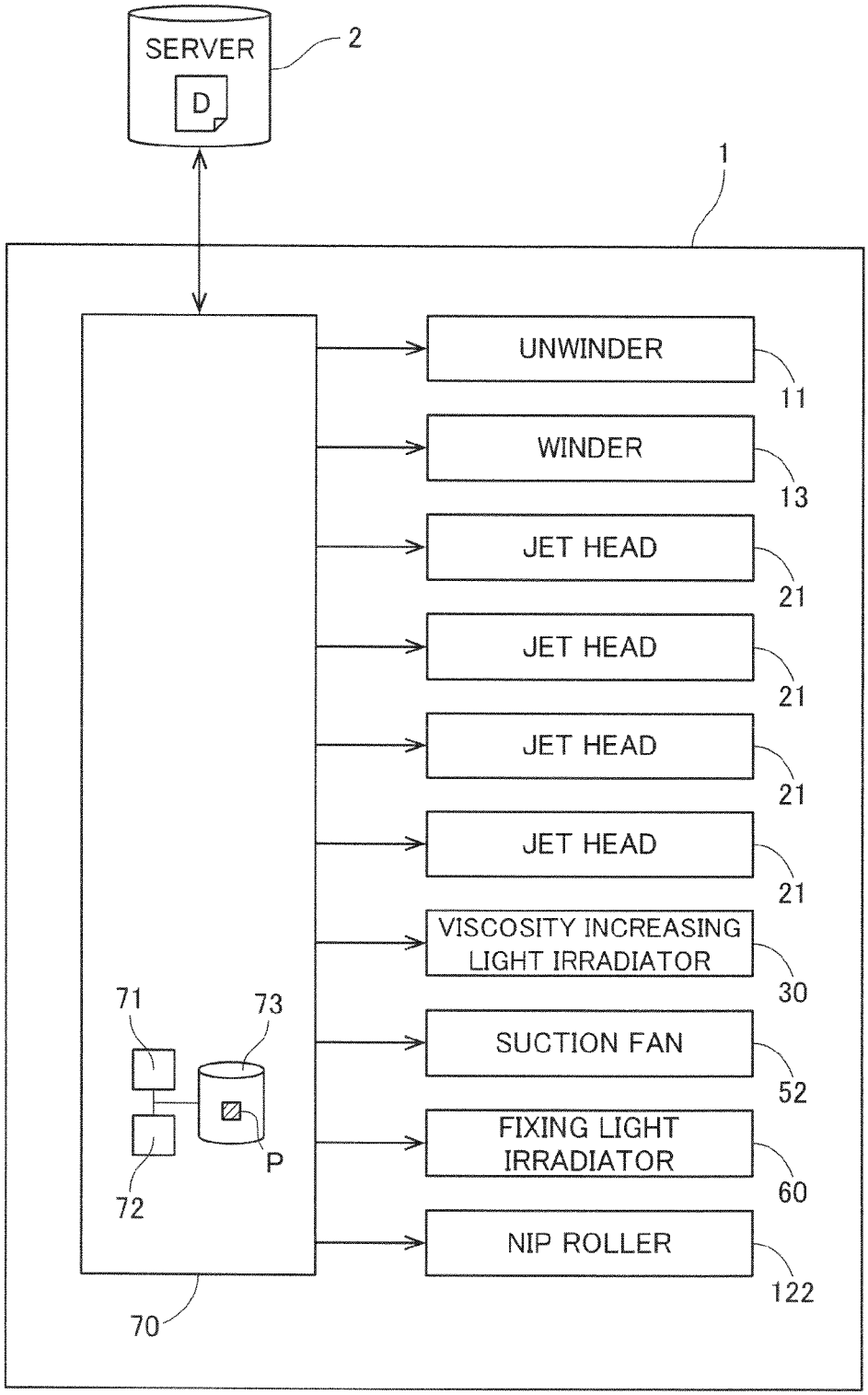
FIG. 2 is a diagram showing the connection and configuration of a controller and components in the inkjet apparatus.

FIG. 2 is a diagram showing the connection and configuration of the controller 70 and the components in the inkjet apparatus 1. As shown in FIG. 2, the controller 70 according to the present preferred embodiment is formed by a computer including an arithmetic processor 71 such as a CPU, a memory 72 such as a RAM, and a storage part 73 such as a hard disk drive. The controller 70 is electrically connected to the unwinder 11, the winder 13, the four jet heads 21, the viscosity increasing light irradiator 30, the suction fan 52, the fixing light irradiator 60 and the nip rollers 122 described above. The controller 70 temporarily reads a computer program P stored in the storage part 73 onto the memory 72. The arithmetic processor 71 performs arithmetic processing based on the computer program P, so that the controller 70 controls the operations of the aforementioned components. Thus, a printing process in the inkjet apparatus 1 proceeds.

The controller 70 is also electrically connected to a server 2 provided outside the inkjet apparatus 1. Image data D to be printed is stored in the server 2. For the printing process, the transport mechanism 10 transports the printing paper 9, and the controller 70 reads a designated piece of image data D from the server 2, so that the four jet heads 21 jet out the ink of the respective colors, based on the designated piece of image data D. As a result, an image corresponding to the designated piece of image data D is recorded on the recording surface of the printing paper 9.

<2. Structures of Jet Heads and Support Bases>

Next, the structures of the jet heads 21 and the support bases 41 will be further described.

Figure 3:
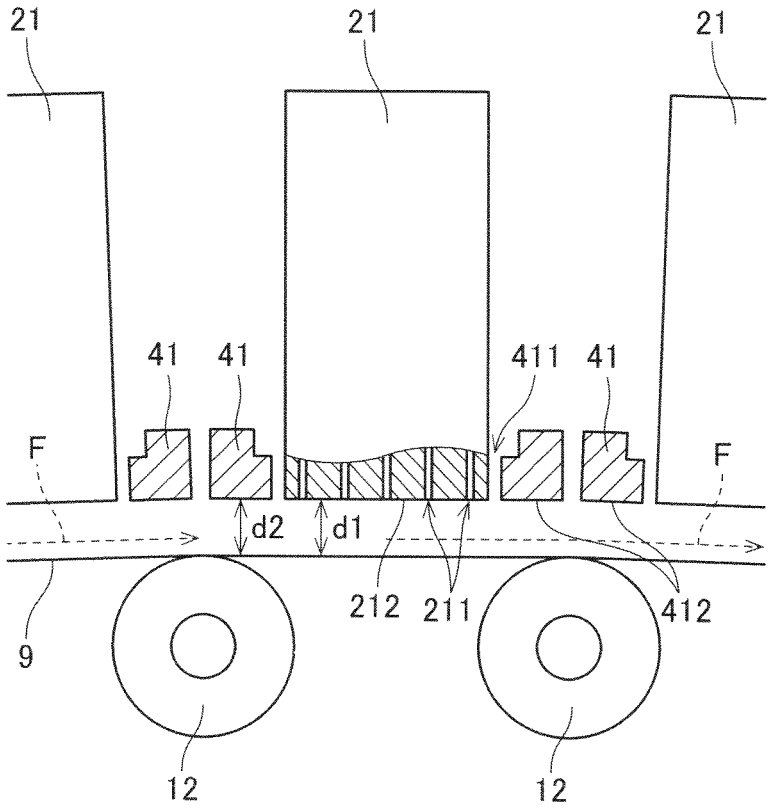
FIG. 3 is a vertical sectional view of jet heads and support bases.

FIG. 3 is a vertical sectional view of the jet heads 21 and the support bases 41. As shown in FIG. 3, each of the jet heads 21 is fixed to a corresponding one of the support bases 41, with the lower end portion of each jet head 21 fitted in the through hole 411 of the corresponding support base 41. The lower surface of each of the jet heads 21 is a nozzle surface 212 having a plurality of nozzles 211 formed therein. When ink droplets are jetted out from the nozzles 211, ink mist having a particle diameter smaller than that of the droplets is accordingly produced.

When the printing paper 9 is transported, a viscous flow F is produced near the recording surface of the printing paper 9, as indicated by broken arrows in FIG. 3. The viscous flow F is an airflow moving together with the printing paper 9 along the recording surface of the printing paper 9. The aforementioned mist is brought into the viscous flow F, and is sent downstream in the direction of movement along with the viscous flow F.

In the present preferred embodiment, parts of the support bases 41 are present at the boundary between adjacent ones of the jet heads 21. This reduces clearance at the boundary between adjacent ones of the jet heads 21. In this manner, the support bases 41 according to the present preferred embodiment function as a blockage member for at least partially blocking the clearance at the boundary between adjacent ones of the jet heads 21. Thus, a turbulent airflow is less prone to occur between the jet heads 21 and the printing paper 9 and between the support bases 41 and the printing paper 9. This allows the ink mist to be efficiently transported downstream along with the viscous flow F. As a result, the adhesion of the mist to the surfaces of the jet heads 21 and the support bases 41 is suppressed.

The reference character d1 designates a distance between the nozzle surfaces 212 of the jet heads 21 and the recording surface of the printing paper 9, and d2 designates a distance between the lower surfaces 412 of the support bases 41 and the recording surface of the printing paper 9. The lower surfaces 412 of the support bases 41 are surfaces opposed to the recording surface of the printing paper 9. The distances d1 and d2 shall be those measured in a direction perpendicular to the recording surface of the printing paper 9. Then, the distances d1 and d2 are approximately equal to each other in the present preferred embodiment. That is, the nozzle surfaces 212 of the jet heads 21 and the lower surfaces 412 of the support bases 41 are located nearly equidistant from the recording surface of the printing paper 9.

Such a structure produces no difference in level (no steps) at the boundaries between the nozzle surfaces 212 of the jet heads 21 and the lower surfaces 412 of the support bases 41. Thus, a turbulent airflow is much less prone to occur at the boundaries between the jet heads 21 and the support bases 41. This allows the ink mist to be more efficiently transported downstream along with the viscous flow F. As a result, the adhesion of the mist to the surfaces of the jet heads 21 and the support bases 41 is further suppressed.

It should be noted that, if the distances d1 and d2 are excessively great, the amount of mist which is not transported along with the viscous flow F but is floating is increased between the jet heads 21 and the printing paper 9 and between the support bases 41 and the printing paper 9. It is hence preferable that the distances d1 and d2 are not excessively great. For example, the distances d1 and d2 which are not greater than 2 mm increases the proportion of the amount of mist transported along with the viscous flow F to the amount of ink mist produced from the jet heads 21. This allows a greater amount of mist to be transported downstream along with the viscous flow F. As an example, the distances d1 and d2 are 1.5 mm in the present preferred embodiment.

<3. Suction of Mist>

Next, the suction of the mist in the mist suction part 50 will be further described.

Figure 4:
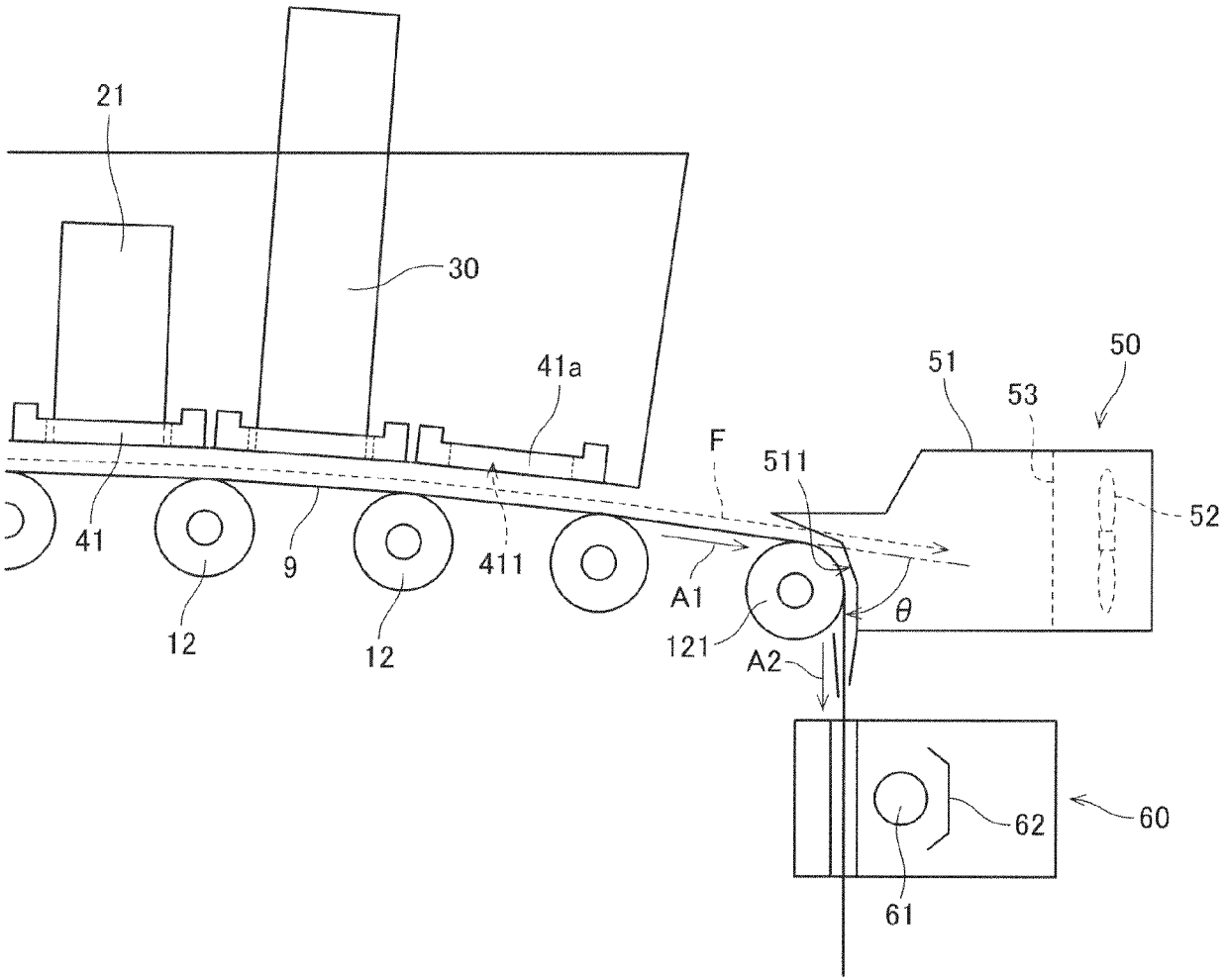
FIG. 4 is a partial enlarged view of the inkjet apparatus around a region extending from a viscosity increasing light irradiator to a fixing light irradiator.

FIG. 4 is a partial enlarged view of the inkjet apparatus 1 around a region extending from the viscosity increasing light irradiator 30 to the fixing light irradiator 60. As indicated by a broken arrow in FIG. 4, the viscous flow F containing the ink mist is sent along the recording surface of the printing paper 9 to near the switching roller 121. As stated above, the printing paper 9 is bent in the direction opposite to the recording surface by passing over the switching roller 121. As a result, the direction of movement of the printing paper 9 is switched from the first direction A1 to the second direction A2.

At this time, the viscous flow F near the surface of the printing paper 9 tends to move in a straight line because of inertial force. Thus, the switching of the direction of movement of the printing paper 9 causes the viscous flow F to be relatively separated from the surface of the printing paper 9. The ink mist contained in the viscous flow F is also relatively separated from the surface of the printing paper 9 because of inertial force.

At least part of the suction opening 511 of the mist suction part 50 is positioned on the extension of the first direction A1. In other words, when extended in the first direction A1 toward the mist suction part 50, the printing paper 9 before the switching intersects the suction opening 511. Thus, the mist separated because of inertial force is efficiently suctioned through the suction opening 511 into the duct 51. This achieves the efficient collection of the ink mist contained in the viscous flow F.

In particular, the suction opening 511 of the mist suction part 50 according to the present preferred embodiment is opposed both to the recording surface of the printing paper 9 moving in the first direction A1 before passing over the switching roller 121 and to the recording surface of the printing paper 9 moving in the second direction A2 after passing over the switching roller 121. This allows the suction of the ink mist from near the recording surface of the printing paper 9 before and after the passage of the printing paper 9 over the switching roller 121, thereby further increasing the rate of collection of the mist.

As shown in FIG. 4, a spare support base 41 is disposed in a position downstream in the direction of movement as viewed from the jet heads 21 and the viscosity increasing light irradiator 30 and upstream in the direction of movement as viewed from the switching roller 121. The spare support base 41 is referred to as a "support base 41*a*" hereinafter.

Neither the jet heads 21 nor the viscosity increasing light irradiator 30 is attached to the spare support base 41*a*. However, the through hole 411 of the support base 41*a* is blocked with a planar lid. As a result, the lower surface of the support base 41*a* is a flat surface extending along the recording surface of the printing paper 9. Thus, the support base 41*a* functions as a flow straightener for suppressing the diffusion of the ink mist in a position downstream from the viscosity increasing light irradiator 30 in the direction of movement. This further increases the rate of collection of the mist in the mist suction part 50.

Figure 5:
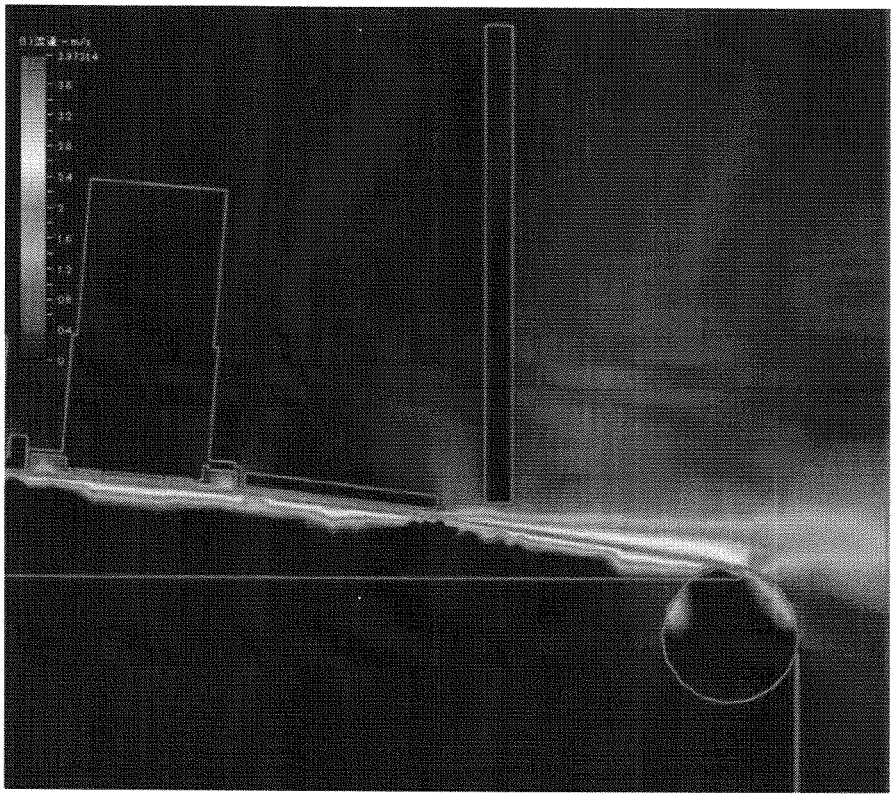
FIGS. 5 to 7 show results of analysis of the motion of a viscous flow near a switching roller by means of simulation software.
Figure 6:
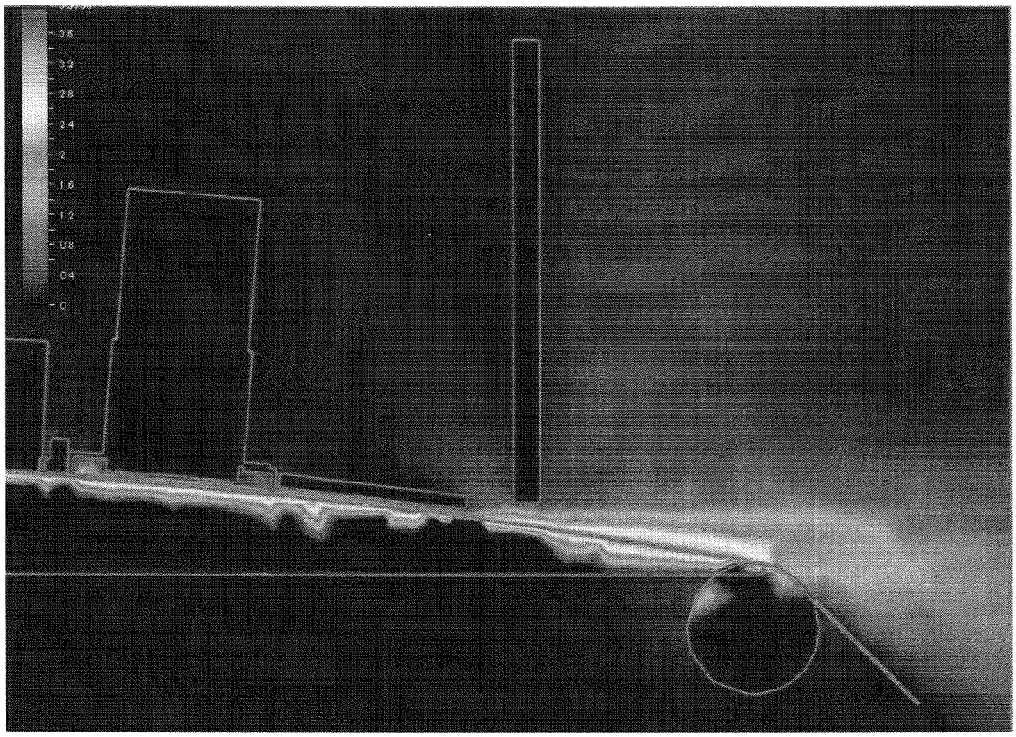
Figure 7:
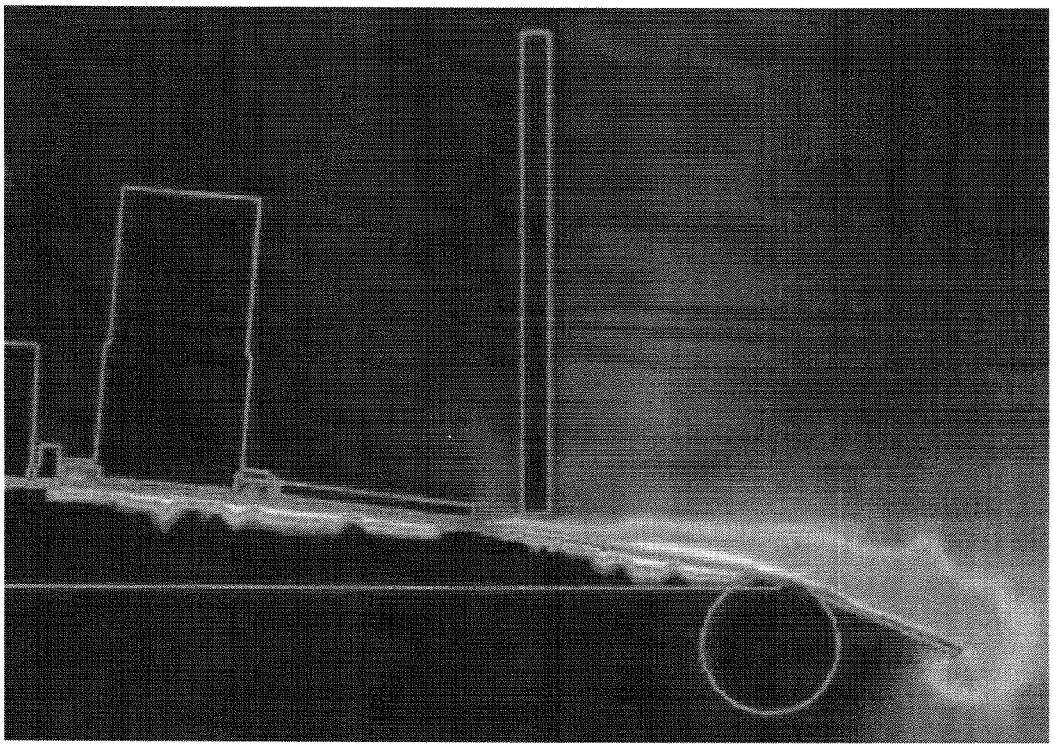

The reference character θ designates an angle by which the direction of movement of the printing paper 9 is changed by the switching roller 121, as shown in FIG. 4. For enhancement of the effect of liberating the mist by using the inertial force, it is preferable that the angle θ is as great as possible and not greater than 180 degrees. FIGS. 5 to 7 show results of analysis of the motion of the viscous flow F near the switching roller 121 by means of fluid analysis simulation software. FIG. 5 shows the result obtained when the angle θ is approximately equal to 90 degrees (θ≈90°); FIG. 6 shows the result obtained when the angle θ is approximately equal to 45 degrees (θ≈45°); and FIG. 7 shows the result obtained when the angle θ is approximately equal to 15 degrees (θ≈15°. In FIGS. 5 to 7, low-density portions represent the viscous flow F.

It is found from the results of FIGS. 5 and 6 that the viscous flow F is separated from the printing paper 9 passing over the switching roller 121. On the other hand, the result of FIG. 7 shows that the viscous flow F is separated to some extent from the recording surface of the printing paper 9 but the major part of the viscous flow F moves along the printing paper 9 after passing over the switching roller 121. Based on these results, it may be said that the angle θ of at least greater than 15 degrees is preferable for the effective separation of the viscous flow F containing the mist from the surface of the printing paper 9. Specifically, the angle θ is preferably not less than 30 degrees, and more preferably not less than 45 degrees.

4. Modifications

While the one preferred embodiment according to the present invention has been described hereinabove, the present invention is not limited to the aforementioned preferred embodiment.

For example, the support bases 41 are used as the blockage member for reducing the clearance at the boundary between adjacent ones of the jet heads 21 in the aforementioned preferred embodiment. Instead, another blockage member than the support bases 41 may be disposed between adjacent ones of the jet heads 21. Also, the clearance at the boundary between adjacent ones of the jet heads 21 may be completely blocked with a blockage member.

Although the spare support base 41*a* is used as the flow straightener for suppressing the diffusion of the mist in the aforementioned preferred embodiment, another member than the support base 41*a* may be used as the flow straightener. Also, the flow straightener may be extended to near the suction opening 511 of the mist suction part 50 to further suppress the diffusion of the mist. Alternatively, the suction opening 511 of the mist suction part 50 may be extended to a more upstream position in the direction of movement than that in the aforementioned preferred embodiment. This further increases the rate of collection of the mist in the mist suction part 50.

In the aforementioned preferred embodiment, the mist suction part 50 is disposed only near the switching roller 121. However, another mist suction part may be disposed in a different location in addition to the mist suction part 50. For example, a mist suction part may be disposed near each of the four jet heads 21. In that case, after these mist suction parts primarily perform the suctioning of the mist near the jet heads 21, the mist suction part 50 disposed downstream may secondarily perform the suctioning of the remainder of the mist left unsuctioned.

The inkjet apparatus 1 according to the aforementioned preferred embodiment has the four jet heads 21. However, the number of jet heads in the inkjet apparatus may be in the range of one to three or not less than five. For example, a jet head for jetting out ink of a spot color may be provided in addition to those for C, M, Y and K. Also, each of the jet heads may include a plurality of heads arranged across the width of the printing paper 9.

The photo-curable ink is used in the aforementioned preferred embodiment. The inkjet apparatus according to the present invention, however, may be an apparatus which jets out other inks such as water-based ink. Also, the aforementioned inkjet apparatus 1 is an apparatus which records an image on the printing paper 9 that is a base material. The inkjet apparatus according to the present invention, however, may be an apparatus which records an image on a strip-shaped base material different than ordinary paper. An example of the base material different than paper includes a film made of resin.

The shapes of the details of the inkjet apparatus may be different from those shown in the figures of the present invention. The components described in the aforementioned preferred embodiment and in the modifications may be consistently combined together, as appropriate.

While the invention has been described in detail, the foregoing description is in all aspects illustrative and not restrictive. It is understood that numerous other modifications and variations can be devised without departing from the scope of the invention.

What is claimed is:

1. An inkjet apparatus comprising:

a transport mechanism for transporting a strip-shaped base material in a direction of movement along the length thereof;

at least one jet head for jetting out ink droplets toward a recording surface of said base material;

a switching part for bending said base material in a direction opposite to said recording surface in a position downstream in said direction of movement as viewed from said at least one jet head to switch said direction of movement from a first direction to a second direction; and a mist suction part for suctioning air containing mist of said ink from near said recording surface of said base material passing over said switching part, said mist suction part including a suction opening at least part of which is positioned on the extension of said first direction.

2. The inkjet apparatus according to claim 1, wherein said suction opening is opposed near said switching part both to the surface of said base material moving in said first direction and to the surface of said base material moving in said second direction.

3. The inkjet apparatus according to claim 1, wherein said switching part switches said direction of movement of said base material through an angle of not less than 30 degrees.

4. The inkjet apparatus according to claim 3, wherein said switching part switches said direction of movement of said base material through an angle of not less than 45 degrees.

5. The inkjet apparatus according to any one of claim 1, wherein said switching part includes a roller rotating about a horizontal axis while contacting the back surface of said base material.

6. The inkjet apparatus according to any one of claim 1, wherein said at least one jet head includes a plurality of jet heads arranged in said direction of movement, said inkjet apparatus further comprising a blockage member for at least partially blocking clearance at a boundary between adjacent ones of said jet heads.

7. The inkjet apparatus according to claim 6, wherein:

each of said jet heads includes a nozzle surface having a plurality of nozzles for jetting out said ink droplets;

said blockage member has a surface opposed to said recording surface of said base material; and said nozzle surface and the opposed surface of said blockage member are located nearly equidistant from said recording surface of said base material.

8. The inkjet apparatus according to claim 7, wherein a distance from said recording surface of said base material to said nozzle surface is not greater than 2 mm.

9. The inkjet apparatus according to any one of claim 1, further comprising a flow straightener disposed in a position downstream in said direction of movement as viewed from said at least one jet head and upstream in said direction of movement as viewed from said switching part, and extending along said recording surface of said base material.

10. A method of collecting mist resulting from the jetting of ink in an inkjet apparatus which jets out ink droplets from at least one jet head toward a recording surface of a strip-shaped base material while transporting the base material, said method comprising the steps of:

a) bending said base material in a direction opposite to said recording surface in a position downstream in a direction of movement of said base material as viewed from said at least one jet head to switch said direction of movement; and b) suctioning air containing said mist separated from said recording surface of said base material in said step a).

11. The method according to claim 10, wherein said direction of movement of said base material is switched through an angle of not less than 30 degrees in said step a).

12. The method according to claim 11, wherein said direction of movement of said base material is switched through an angle of not less than 45 degrees in said step a).

13. The method according to any one of claim 10, wherein said direction of movement is switched by a roller contacting the back surface of said base material in said step a).

14. The method according to claim 13, wherein said mist is suctioned from near said recording surface of said base material before and after said base material passes over said roller in said step b).

15. The method according to claim 13, wherein the diffusion of said mist is suppressed between said at east one jet head and said roller.

16. The method according to any one of claim 10, wherein said at least one jet head includes a plurality of jet heads, and said base material is transported while clearance at a boundary between adjacent ones of said jet heads is at least partially blocked.

* * * * *